US005486045A

United States Patent [19]

Dasher

[11] Patent Number: 5,486,045

[45] Date of Patent: Jan. 23, 1996

[54] SHELF LADDER REINFORCEMENT MEMBER FOR A REFRIGERATION APPLIANCE

[75] Inventor: James F. Dasher, Center Township, Vanderburgh County, Ind.

[73] Assignee: Whirlpool Corporation, Benton Harbor, Mich.

[21] Appl. No.: 143,587

[22] Filed: Nov. 1, 1993

[51] Int. Cl.[6] ..... A47B 96/04

[52] U.S. Cl. ..... 312/406; 52/730.6; 52/731.7; 248/300; 312/408

[58] Field of Search ..... 248/312, 300; 52/731.7, 730.6, 793; 312/406, 408, 401, 480

[56] References Cited

U.S. PATENT DOCUMENTS

| | | | |
|---|---|---|---|
| 2,328,421 | 8/1943 | Carlson et al. | 248/300 |
| 3,128,979 | 4/1964 | Damelio | 248/300 |
| 3,707,317 | 12/1972 | Dawley et al. | 312/408 |
| 4,107,833 | 8/1978 | Knight et al. | 29/460 |
| 4,190,305 | 2/1980 | Knight et al. | 312/214 |
| 4,448,464 | 5/1984 | Reichert et al. | 312/214 |
| 4,462,645 | 7/1984 | Ballarin et al. | 312/214 |
| 5,004,302 | 4/1991 | Stocking et al. | 312/214 |

*Primary Examiner*—Kenneth J. Dorner
*Assistant Examiner*—Gerard A. Anderson
*Attorney, Agent, or Firm*—Thomas J. Roth

[57] ABSTRACT

A shelf ladder reinforcement member is provided for use with a refrigerator having a thin liner which defines an interior compartment and in which a shelf ladder is to be secured for supporting shelves. The shelf ladder reinforcement member has a length greater than a width and has end portions with flat faces of a width substantially the same as the width of the member and intermediate portions having a flat face with a width less than the width of the member. A central portion may also be provided with a flat face having a width substantially the same as the width of the member with the first, second and third flat faces adjoining each other in a coplanar fashion.

The shelf ladder reinforcement member has side walls which are angled away from the flat faces to strengthen and reinforce the member. The side walls at the first and third flat faces extend away from the flat faces by an angle of approximately 270° while the side walls at the second flat faces extend away from the second flat faces at an angle in the range of 185°–265° and preferably in the range of 220°–230°. Apertures are formed in the end portions and in the central portion for receiving a fastening member with the apertures formed approximately in the center of the first and third flat faces.

13 Claims, 2 Drawing Sheets

SHELF LADDER REINFORCEMENT MEMBER FOR A REFRIGERATION APPLIANCE

BACKGROUND OF THE INVENTION

The present invention relates to a reinforcement member for a shelf ladder to provide backing and support behind a relatively thin walled liner in a refrigeration appliance, the reinforcement member to receive a threaded fastener extending through the shelf ladder, liner and reinforcement member.

In refrigeration appliances shelves are provided to support articles within the refrigeration compartment. In order to easily accommodate the needs of various customers, shelving systems have been provided which are adjustable in position. One manner of providing this adjustability is to attach shelf ladders to a rear wall of the refrigeration compartment and to use cantilevered shelves having brackets at their rear side to engage into the shelf ladder in a plurality of vertical positions.

Typically the rear wall of a refrigeration unit is a relatively thin liner which is spaced inwardly from an outer cabinet wall, with the intervening space filled with an insulation material. The thin walled liner does not have sufficient strength to support the shelf ladder by itself, and therefore reinforcement members are needed to provide the necessary backing and support for the liner.

SUMMARY OF THE INVENTION

The present invention provides a reinforcement member for a shelf ladder in which the member has an elongated form with a length greater than a width. End portions of the member have a flat face with a width substantially the same as the width of the member in order to provide a large supporting surface area. Portions of the member intermediate the ends have a flat face with a width that is approximately one half of the width of the member, the second flat faces joining with the first flat faces at the ends of the member.

At each long edge of the member is located a reinforcing and strength providing side wall. At the ends of the reinforcement member the side wall is bent rearwardly approximately 90° such that the side walls extend from the flat face by approximately 270°. At the intermediate portions of the reinforcement member, the side walls are bent rearwardly at a lesser angle than the side walls at the ends, which allows the side walls to have a greater length for engagement into the insulation, and providing a large support surface. Although the side walls could be angled from the flat face at an angle in the range of 185°–265°, preferably the angle is in the range of 220°–230°. Such an arrangement allows for a large side wall area to extend at an angle rearwardly from the front face so as to extend into the insulation area between the liner and the cabinet.

In a preferred refrigeration device, the insulation is an expandable foam material which is applied in a liquid form and which expands to fill the entire space between the liner and the cabinet wall and then solidifies to provide structural strength to the cabinet. With the angled side walls of the reinforcement member being surrounded by the foam, the reinforcement member becomes integrated into the structure of the cabinet to provide greater support for the shelf ladder.

DETAILED DESCRIPTION OF THE PREFERRED EMBODIMENTS

Figure 1:
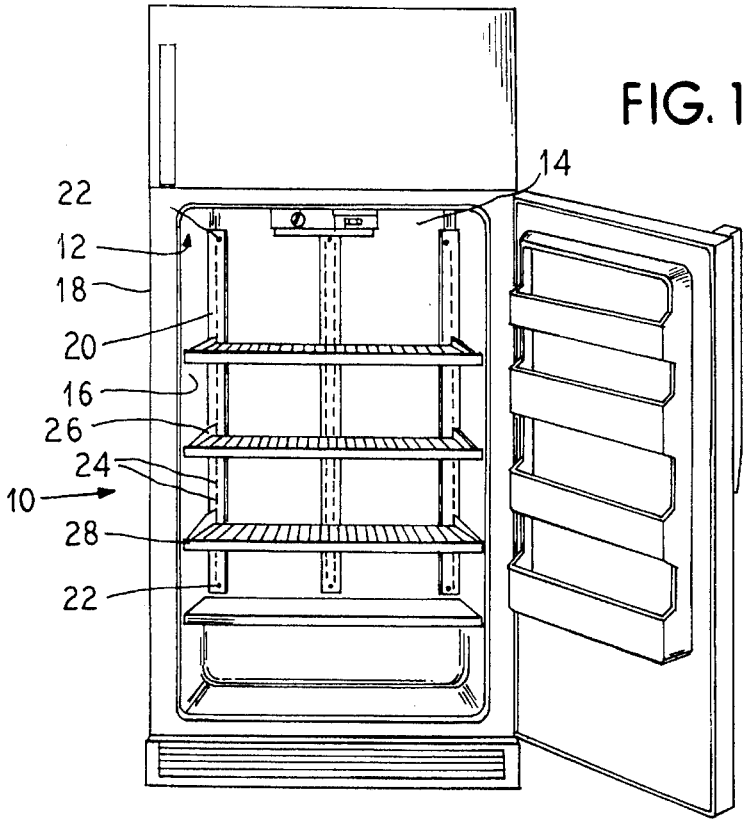
FIG. 1 is a front elevational view of a refrigeration device opened to show the interior refrigeration compartment.
Figure 3:
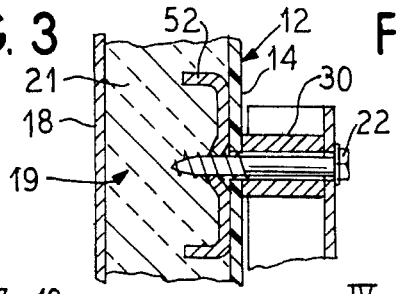
FIG. 3 is a side sectional view taken generally along the line III—III of FIG. 2.
Figure 4:
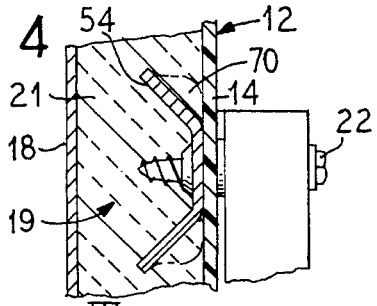
FIG. 4 is a side sectional view taken generally along the line IV—IV of FIG. 2.
Figure 2:
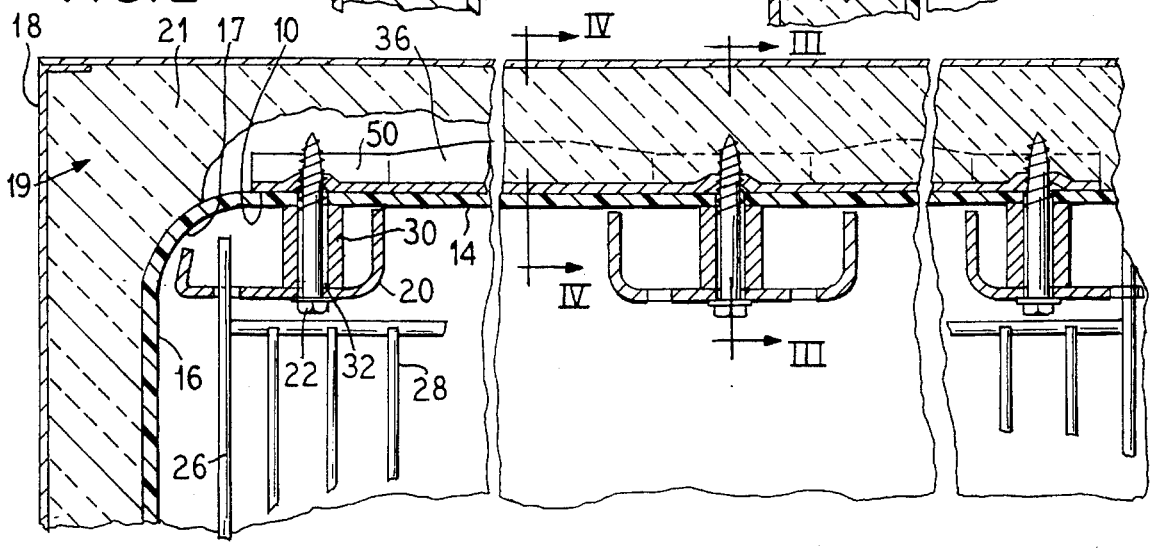
FIG. 2 is a horizontal sectional view through a rear portion of the refrigeration device of FIG. 1 illustrating the shelving mounting ladder and reinforcement member of the present invention.

In FIGS. 1–4 there is illustrated a refrigeration appliance 10 which includes a liner 12 having a back wall 14 and side walls 16. The side walls 16 are connected to the back wall 14 by rounded corners 17 having a large radius, on the order of 15–20 millimeters.

An outer cabinet wall 18 defines the outside shape of the refrigeration appliance 10. The liner 12 is spaced inwardly of the cabinet wall 18 and an intervening space 19 is filled with an insulation material 21. Preferably the insulation material is a foamed insulation such as polyurethane foam which is injected into the space 19 in a liquid form and then it expands to fill the entire space and hardens to a solid providing structural strength for the cabinet.

A shelf ladder 20 in the form of an elongated member is mounted vertically to the inside of the liner 12 by a number of mounting screws 22. The shelf ladder 20 includes a plurality of vertical slots 24. Shelf mounting brackets 26 form the side walls of shelves 28 with the brackets 26 being secured in the slots 24 to support the shelves within the refrigeration appliance 10.

The shelf ladders 20 are held away from the thin liner 16 by spacers 30 extending between the shelf ladders and the thin liner to prevent contact therebetween and to prevent damage to the liner by the sharp edges of the shelf ladder. The shelf ladders 20 are provided with an aperture 32 for receiving the threaded fastener 22 which also extends through the spacer 30. The liner 16, which preferably is formed of a plastic material, is not thick enough or strong enough to support the shelf ladder and spacer on its own, and therefore a reinforcing member 36 is provided to be engaged by the threaded fasteners 22.

Figure 6:
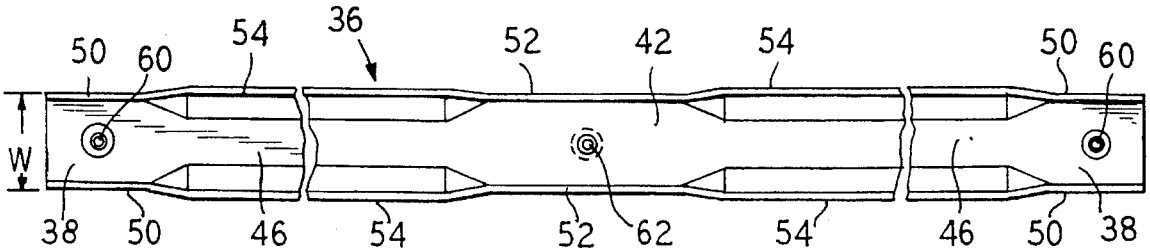
FIG. 6 is a plan view of the reinforcement member of the present invention in isolation.
Figure 7:
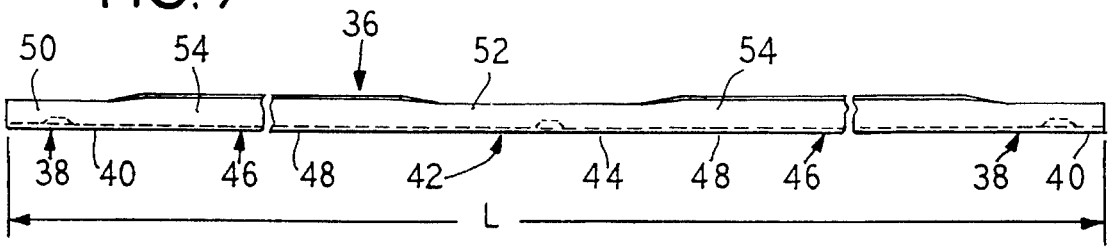
FIG. 7 is a side elevational view of the reinforcement member.

The reinforcement member is shown in greater detail in isolation in FIGS. 6 and 7 is an elongated member with a length L greater than a width W. The reinforcement member 36 has end portions 38 having a first flat face 40 with a width substantially the same as the width W of the reinforcement member 36. The reinforcement member may also have a central portion 42 with a second flat face 44 having a width the same as the width of the reinforcing member 36. Intermediate portions 46 have a third flat face 48 which join with the first and second flat faces 40, 44. The third flat faces have a width less than the width W of the member, and, preferably, a width of approximately one half of the width of the member.

The reinforcement member 36 includes side walls 50 extending rearwardly at the end portions 38 such that the side walls 50 are oriented at an angle of approximately 270° from the first flat faces 40. The reinforcement member 36 has side walls 52 which extend rearwardly at approximately a right angle from the central portion 42 such that the walls 52 extend from the second flat faces at an angle of approximately 270°. The side walls 50 and 52 extend from both sides of the flat faces 40 and 42 to form a U-shaped cross-section. The reinforcement member 36 also has side walls 54 extending rearwardly from the intermediate portions 46 at an outward angle so that the side walls 54 extend from the third flat faces 48 at an angle in the range of 185°–265°, and preferably, in the range of 220°–230°. Side walls 50 and 52 integrally transition into the side walls 54 such that the reinforcement member 38 is provided with a continuous flange structure on both sides.

Apertures 60 are formed in the end portions 38, approximately in the center of the first flat faces 40. An aperture 62 is formed in the central portion 42, approximately in the center of the second flat face 44.

Figure 5:
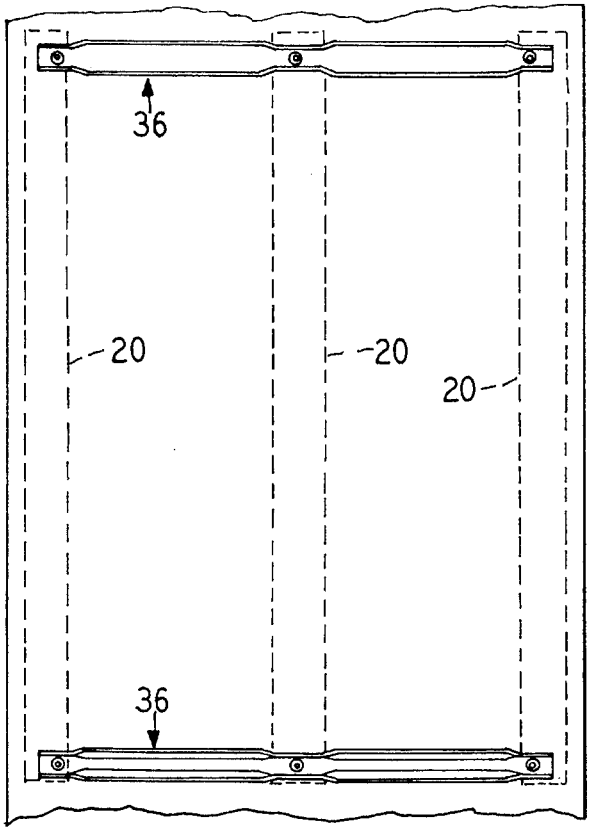
FIG. 5 is a rear elevational view of the liner of the refrigeration compartment showing the reinforcement members secured in place.

The side walls 50, 52, 54 act as reinforcing means for the reinforcement member and provide it with beam strength along its length. The flat faces 38, 40 provide large bearing support surfaces to back and support those areas of the liner 12 which are engaged by the shelf ladders 20. The reinforcement members 36 are positioned horizontally (FIG. 5) to each support a plurality of vertically extending shelf ladders 20. The outwardly angled side walls 54, in addition to providing reinforcement strength to the reinforcement member 36 itself, also provide a pocket area 70 (FIG. 4) between the liner 16 and the side wall 52.

The liner 12 is spaced inwardly of the outer cabinet wall 18 and, preferably, as described above the intervening space 19 is filled with an insulation material 21 which is injected into the space in a liquid form, and then which expands to completely fill the space and solidify. Thus, this insulation material 21 will fill the pocket area 70, as well as the remaining space 19 between the liner 12 and the cabinet wall 18 and the angled side wall 54 will lock the reinforcement member 36 into the insulation material 21 to further integrate the reinforcement member into the structure of the refrigerator cabinet.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A shelf ladder reinforcement member comprising:

a member with a length greater than a width and with end portions having a first flat face with a width substantially the same as the width of said member, at least one intermediate portion having a second flat face adjoining said first flat faces, said second flat face having a width less than the width of said member, side walls extending from said first flat face at approximately 270°, and alternatingly side walls extending from said second flat faces at an angle in the range of 185°–265°.

2. A shelf ladder reinforcement member according to claim 1, wherein said member includes a central portion having a third flat face with a width substantially the same as the width of said member and adjoining said second flat face.

3. A shelf ladder reinforcement member according to claim 1, wherein:

each of said second flat faces have opposite side edges defining said width of said second flat faces, and said side walls extending from said opposite side edges of said second flat faces at an angle in the range of 185°–265°.

4. A shelf ladder reinforcement member according to claim 1, wherein:

each of said side walls extending from said first flat faces have a first predetermined length; and each of said side walls extending from said opposite edges of said second flat face at an angle have a second predetermined length wherein said second predetermined length is greater than said first predetermined length.

5. A shelf ladder reinforcement member according to claim 1, wherein said angle is in the range of 220° to 230°.

6. A shelf ladder reinforcement member according to claim 1, wherein said member includes an aperture formed in said end portions.

7. A shelf ladder reinforcement member according to claim 6, wherein said apertures are formed approximately at a center of said first flat faces.

8. A shelf ladder reinforcement member according to claim 1, wherein said second flat face at said intermediate portion has a width of approximately one half of the width of said member.

9. A shelf ladder reinforcement member for use with a refrigerator having a thin liner defining an interior compartment, an outer skin, and an expandable foam insulation therebetween, comprising:

a member with a length greater than a width and with end portions having a first flat face with a width substantially the same as the width of said member, a central portion having a second flat face with a width substantially the same as the width of said member, intermediate portions having a third flat face adjoining said first and second flat faces, said third flat face having a width less than the width of said member, perpendicular side walls extending from said first and second flat faces at approximately 270°, angled side walls extending from said third flat faces at an angle in the range of 185–265 to be surrounded by said insulation foam, said perpendicular side walls integrally transitioning into said angled side walls such that said perpendicular side walls and said angled side walls form a continuous structure, and an aperture formed in said end portions and said central portion at a center of said first flat faces and said second flat faces.

10. A shelf ladder reinforcement member according to claim 9, wherein:

said perpendicular side walls form a U-shaped cross section along said end portions and said central portion, said angled side walls integrally transition into said angled side walls such that said perpendicular side walls and said angled side walls form a continuous structure along both edges of said reinforcement member.

11. A shelf ladder reinforcement member according to claim 9, wherein:

each of said perpendicular side walls have a first predetermined length; and each of said angled side walls have a second predetermined length wherein said second predetermined length is greater than said first predetermined length.

12. A shelf ladder reinforcement member according to claim 9, wherein said angle of said angled side walls extending from said third flat faces is in the range of 220° to 230°.

13. A shelf ladder reinforcement member according to claim 9, wherein said second flat face at said intermediate portions has a width of approximately one half of the width of said member.

* * * * *